US005978643A

United States Patent [19]

Uno

[11] Patent Number: 5,978,643

[45] **Date of Patent: *Nov. 2, 1999**

[54] ELECTROPHOTOGRAPHIC APPARATUS WHICH REDUCES RUNNING COST BY STARTING IMAGE FORMING PROCESSES IN RESPONSE TO SHEET DETECTORS

[75] Inventor: Mugijirou Uno, Isehara, Japan

[73] Assignee: Ricoh Company, Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/828,286

[22] Filed: Mar. 21, 1997

[30] Foreign Application Priority Data

Mar. 21, 1996 [JP] Japan ..... P08-091940

[51] Int. Cl.[6] ..... G03G 15/00

[52] U.S. Cl. ..... 399/391; 399/50; 399/167

[58] Field of Search ..... 399/45, 66, 388, 399/389, 391, 50, 38, 394, 51, 159, 167; 347/139, 262, 154

[56] References Cited

U.S. PATENT DOCUMENTS

| | | | |
|---|---|---|---|
| 4,580,890 | 4/1986 | Sugizaki et al. | 399/391 |
| 4,647,946 | 3/1987 | Inuyama . | |
| 4,894,669 | 1/1990 | Sugiura et al. . | |
| 4,922,272 | 5/1990 | Wakamatsu et al. . | |
| 4,933,772 | 6/1990 | Ikenoue et al. | 358/300 |
| 5,323,220 | 6/1994 | Yasuda | 399/391 |
| 5,694,158 | 12/1997 | Kato et al. | 347/139 |

FOREIGN PATENT DOCUMENTS

| | | |
|---|---|---|
| 60-113253 | 6/1985 | Japan . |
| 62-187361 | 8/1987 | Japan . |
| 1-093361 | 4/1989 | Japan . |

*Primary Examiner*—Robert Beatty

*Attorney, Agent, or Firm*—Oblon, Spivak, McClelland, Maier & Neustadt, P.C.

[57] ABSTRACT

An electrophotographic apparatus is provided with suppressed or eliminated electrostatic fatigue and physical wearing-off of a photoconductive element and drive system layout, and is further provided with resultant reduced running cost which is realized by minimum rotation of a photoconductive element and minimum applying time of an impressive charger for each image forming procedure. The electrophotographic apparatus is provided with optional feeders in addition to a main feeder, and a detecting device is provided at a position capable of detecting a tip end position of a recording sheet at an upper stream of a transfer process, from any of the main sheet feeder or the optional sheet feeders, in which a photoconductive element motor or charge applying process is started in accordance with an output of the recording sheet detecting device.

5 Claims, 9 Drawing Sheets

Image forming operation is omitted.

ELECTROPHOTOGRAPHIC APPARATUS WHICH REDUCES RUNNING COST BY STARTING IMAGE FORMING PROCESSES IN RESPONSE TO SHEET DETECTORS

BACKGROUND OF THE INVENTION

1. Field of the Invention

The present invention relates to an electrophotographic apparatus, in particular, to an electrophotographic apparatus such as a copying machine, a plane paper facsimile device, a printer, or the like.

2. Discussion of the Background

FIG. 8 is a schematic diagram showing the construction of a main part of an electrophotographic apparatus for explaining an outline of its electrophotographic process. In the case as shown in FIG. 8, a photoconductive element 1 rotates in a counterclockwise direction (direction indicated by an arrow). The surface of the photoconductive element 1 is uniformly charged at a charge applying section 2 is well known, and a latent image is formed by being exposed by an optical writing section 3 which moves in accordance with the rotation of the photoconductive element 1. The photoconductive element 1 further rotates, and the element is developed by toner which selectively adheres onto the surface of the photoconductive element 1 corresponding to the latent image by a developing section 4, and thereby a toner image is formed. The toner image contacts a cut sheet 10 which is conveyed from a sheet feeding roller 11 and registration rollers pair 12 at a transfer section 5 in synchronizing with a predetermined timing, and that is transferred onto the cut sheet 10.

The toner image transferred on the cut sheet 10 is fixed thereon at a fixing section 6, and the cut sheet 10 having the fixed toner image thereon is discharged, as a hard copy, outside of the main body from a sheet discharging section 7.

Furthermore, the photoconductive element 1 has the toner or the like which is not completely transferred onto the sheet at the transfer section 5, and is collected at a cleaning section 8. The voltage on the surface of the photoconductive element 1 is made equal to approximately 0 volt at a discharging section 9 after the position on the surface of the photoconductive element 1 passes though the transfer section 5, the toner or the like which is not completely transferred onto the sheet at the transfer section 5 is withdrawn at a cleaning section 8. And then, aforementioned portion on the surface of the photoconductive element 1 returns to the charge applying charger section 2 once again. The photoconductive element 1 continuously forms a hardcopy by repeating the aforementioned series of operation.

FIG. 9 is a schematic diagram showing the entire construction of the electrophotographic apparatus to which the present invention is applied. In FIG. 9, a reference numeral 21 denotes a sheet feeding section of the main body (hereinafter called "main sheet feeder"), a reference numeral 22*a* a first optional sheet feeding section (optional sheet feeding section is hereinafter called "optional sheet feeder"), a reference numeral 22*b* a second optional feeder, and a reference numeral 22*c* a third optional sheet feeder.

FIG. 10 is a flow chart showing an example of a method of controlling a conventional electrophotographic apparatus. In the conventional electrophotographic apparatus, a photoconductive element drive motor (not shown) starts regardless of a kind of the selected feeder (main feeder or optional feeder), and the motor always starts when a page memory (a memory for individually storing image information for every one page in a bit-map format) is brought to a "Full" state. However, it takes long time for a recording sheet fed from the optional sheet feeder to reach a transfer nip K in comparison with a recording sheet fed from the main sheet feeder, for the reason that the sheet feeding distance from a sheet feeding start position to a transfer nip K of the optional sheet feeder is longer than that of a main sheet feeder, and further, in the case of using a roll sheet feeder, it takes much longer time to execute the paper feeding operation from a sheet feeding start position to another position of a transfer nip K where the recording paper reaches than in the case of using the main sheet feeder. The above matter occurs, because cutting operation of the recording sheet is needed in addition to the sheet feeding operation. Therefore, in the case of executing the above optional sheet feeding operation, the photoconductive element is rotated for much longer time than the necessary time in comparison with the case of feeding the sheets from the main sheet feeder. For this reason, for example, electrostatic fatigue or amount of physical wear of the photoconductive element in the case of executing the sheet feeding operation of the optional sheet feeder is much larger in comparison with the case of executing that of the main sheet feeder, and therefore, some problems to be solved in the lifetime of the photoconductive element and the drive system of the main body may happen on some occasions.

Therefore, the present invention is made in light of an above-mentioned problem.

SUMMARY OF THE INVENTION

The present invention has been made in view of such problems as mentioned heretofore. Accordingly, it is an object of the present invention to make the revolution number of the photoconductive element when the sheet is outputting the hard copy in feeding the sheet from the optional sheet feeder equal to that of the main sheet feeder, as a minimal revolution number of the photoconductive element by providing a recording sheet's tip end position detecting device at the upper-stream of the conveying path for the recording sheet of the transfer section, and thereby to suppress the electrostatic fatigue or wearing-off of the photoconductive element and further suppress the physical wearing-off of the driving system, and as a result to reducing cost.

It is another object of the present invention to provide an electrophotographic apparatus capable of reducing running cost of the apparatus by suppressing the electrostatic fatigue, the physical wear of the photoconductive element, and further suppressing the fatigue of the drive system by making minimal the number of the revolutions of the photoconductive element in the case of feeding the sheet from the optional sheet feeder for outputting the hardcopy as well as in the case of feeding the sheet from the main sheet feeder, by controlling delay of drive start timing of a main motor when feeding sheet from each of optional sheet feeders selected by a controller according to size of the recording sheet (for example, according to an amount of data in a page memory, or according to data of a protocol or printer output information).

It is still another object of the present invention to provide an electrophotographic apparatus capable of reducing running cost of the apparatus by suppressing electrostatic fatigue, physical wear of a photoconductive element, and further suppressing fatigue of a drive system by making minimal a number of the revolutions of the photoconductive element in the case of feeding the sheet from the optional sheet feeder as well as in the case of feeding the sheet from a main sheet feeder, when the apparatus is provided with only one optional sheet feeder, by pre-feeding the recording sheet from the optional sheet feeder until reaching a position in which a toner image on the photoconductive element for the recording sheet fed from the optional sheet feeder is synchronized with the toner image on the photoconductive element for the recording sheet fed from the main sheet feeder, and making the recording sheet always in a "Waiting" state.

It is still another object of the present invention to provide an electrophotographic apparatus capable of reducing running cost of the apparatus by suppressing electrostatic fatigue, by making minimal time of accepting an electric field in the case of feeding the sheet from the optional sheet feeder for outputting the hardcopy as well as in the case of feeding the sheet from the main sheet feeder, by controlling a charging device according to the detecting time of the tip end detecting device mounted at the upper stream of the recording sheet conveying path of the transfer section in the case of feeding the sheet from the optional sheet feeder for outputting the hardcopy as well as in the case of feeding sheet from the main sheet feeder.

It is still another object of the present invention to provide an electrophotographic apparatus capable of reducing running cost of the apparatus by suppressing electrostatic fatigue of the photoconductive element by making minimal the accepting time of the electric field of the photoconductive element in the case of feeding the sheet from the optional sheet feeder for outputting the hardcopy as well as in the case of feeding sheet from the main by controlling the delay of the drive start timing of the charging device in each of the optional sheet feeders selected according to the size of the recording sheet (for example, an amount of data in she page memory, or information of the protocol or outputting information of a printer).

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS (First Embodiment)

Figure 1:
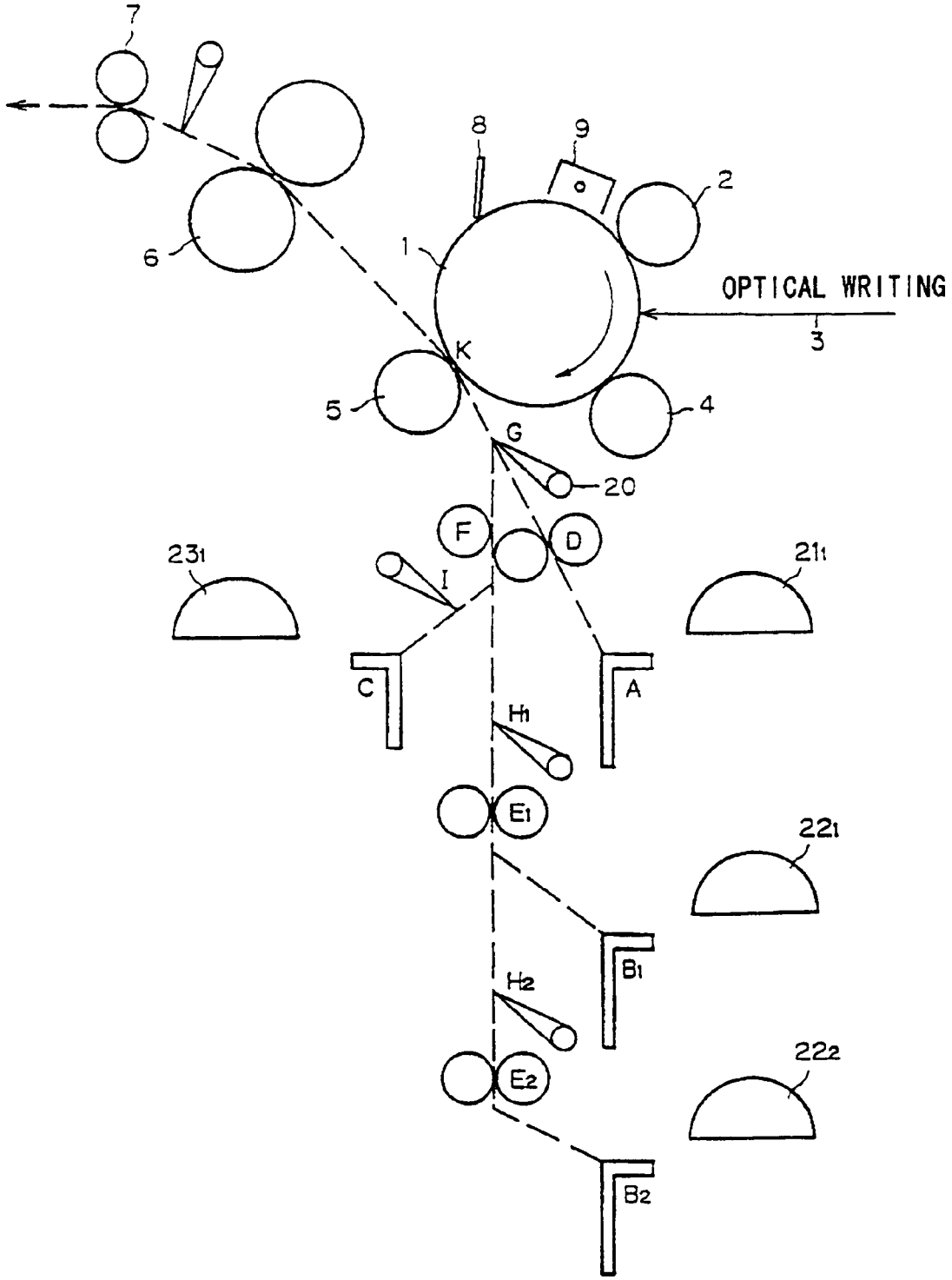
FIG. 1 is a schematic diagram showing the construction of the main part of an electrophotographic apparatus for explaining an embodiment according to the present invention.
Figure 8:
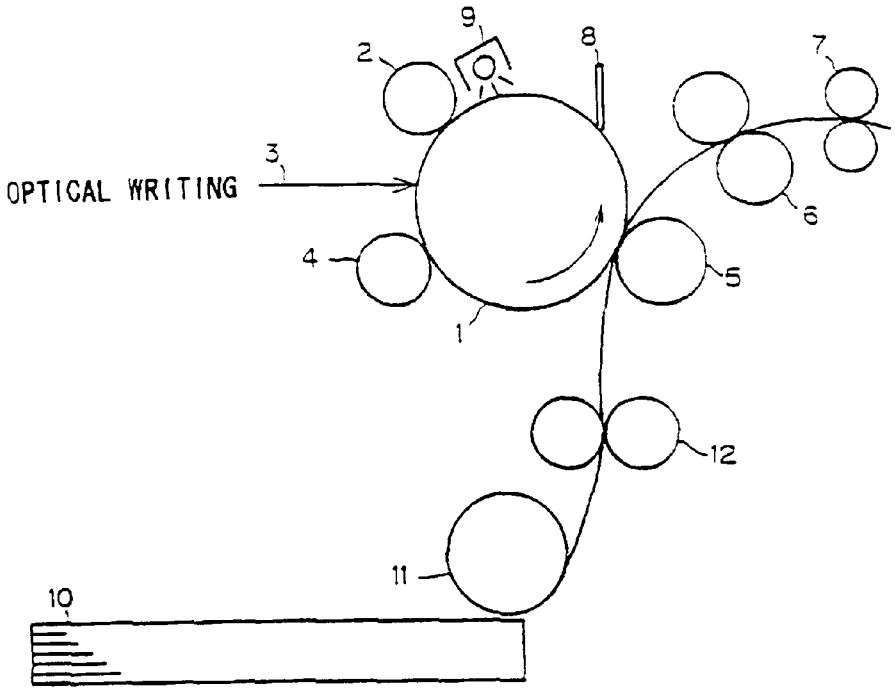
FIG. 8 is a schematic diagram showing the construction of a main part of an electrophotographic apparatus for explaining an outline of its electrophotographic process.
Figure 9:
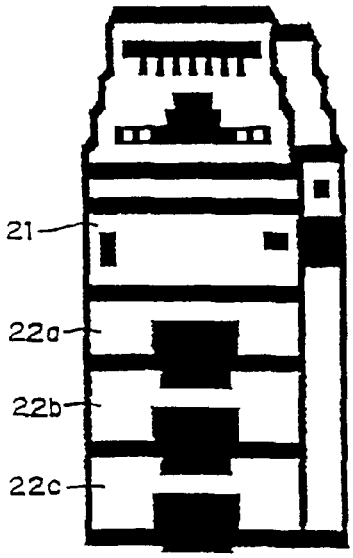
FIG. 9 is a schematic diagram showing the entire construction of the electrophotographic apparatus to which the present invention is applied.
Figure 10:
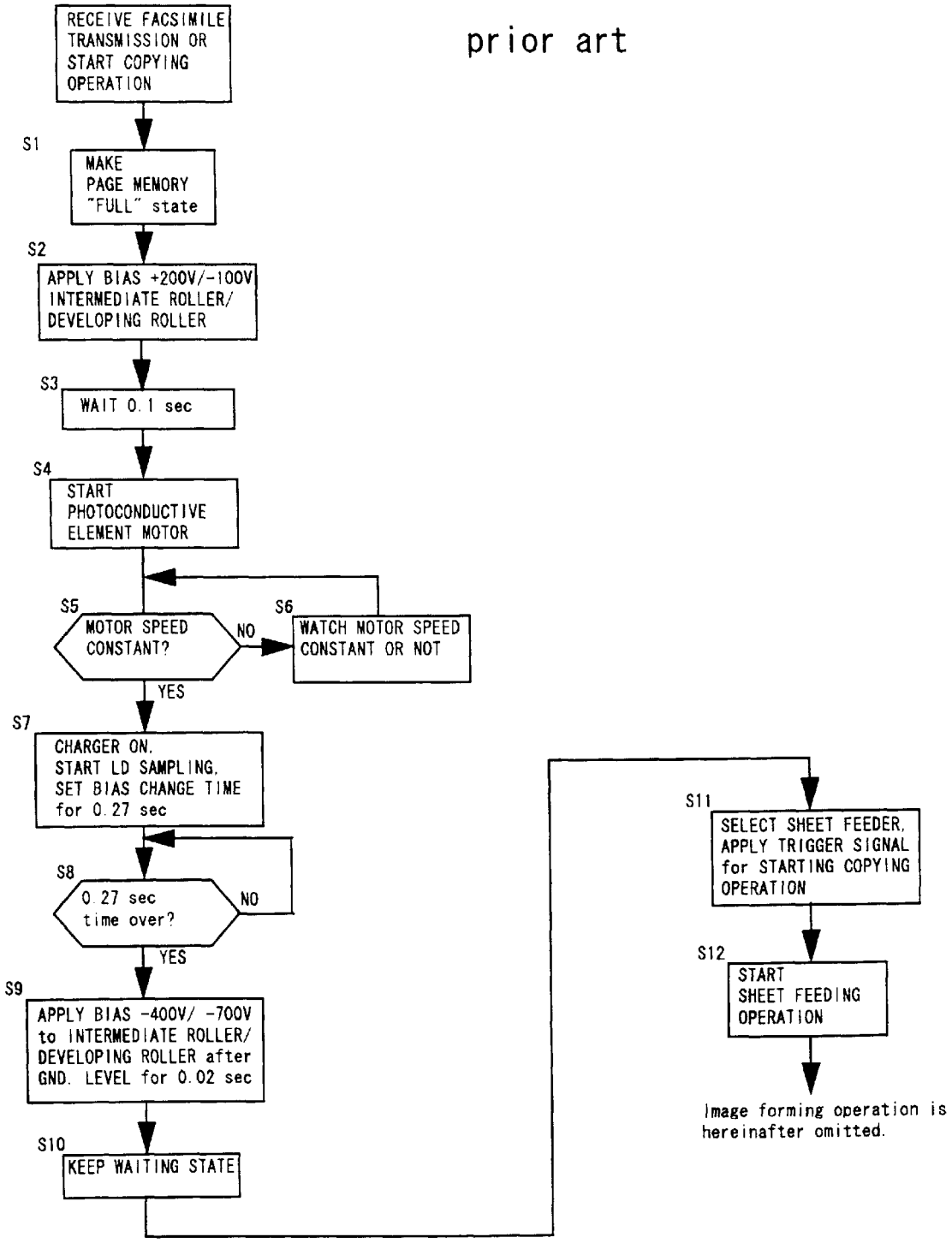
FIG. 10 prior art
FIG. 10 is a flowchart showing an example of method of controlling a conventional electrophotographic apparatus.

FIG. 1 is a construction explaining all of the embodiments of the present invention. A reference numeral $\mathbf{21}_1$ denotes a main sheet feeder, a reference numeral $\mathbf{22}_1$ a first optional sheet feeder, a reference numeral $\mathbf{22}_2$ a second optional sheet feeder, a reference numeral $\mathbf{23}_1$ a simple sheet feeder, a reference numeral A tip end position of a recording sheet of the main sheet feeder, a reference numeral $B_1$ a tip end position of the recording sheet of the first optional sheet feeder, a reference numeral $B_2$ a tip end position of the recording sheet of the second optional sheet feeder, a reference numeral C a tip end position of the recording sheet of the simple sheet feeder, a reference numeral D a nip position of the registration rollers pair of the main sheet feeder, a reference numeral $E_1$ a nip position of feeding rollers of the first optional sheet feeder, a reference numeral $E_2$ a nip position of feeding rollers of the second optional sheet feeder, a reference numeral F a nip position of feeding rollers of the simple sheet feeder, a reference numeral G a turning on position of the registration sensor of the tip end position detecting device 20, a reference numeral $H_1$ a turning on position of the sheet feeding sensor of the first optional sheet feeder, a reference numeral $H_2$ a turning on position of the sheet feeding sensor of the second optional sheet feeder, and a reference numeral I a turning on position of the sheet feeding sensor of a hand inserting sheet feeder. Furthermore, the same reference number as shown in FIG. 8 is put for the same functional part or section as shown in the electrophotographic apparatus of FIG. 8.

In an image forming system, a minimal rotating time period needed at the lowest from the starting of the rotation of the photoconductive element 1 to the arrival of the recording sheet 10 at the transfer section 5 is:

$$t_1(\text{sec})+t_2(\text{sec}),$$

assuming that;

(1) $t_1$ (sec) is a time period needed for starting up the photoconductive element drive motor (the time period needed from the turning-on of the motor to the arrival of the motor's revolution number at the regular revolution number), and (2) $t_2$ (sec) is a time period needed for executing the optical writing onto the photoconductive element 1 after locking (the arrival of the regular revolution number of the motor) the photoconductive element drive motor in order to form an image with toner, and further conveying the developed toner image to the position of the transfer nip K (the time period needed for moving the photoconductive element 1 from the optical writing position to the other position on the transfer nip K).

Furthermore, a mounting position G of a tip end position detecting device 20 (turning on position of the registration sensor) is selected so as to satisfy below equation.

$$1_1 \leqq (t_1+t_2)\times v_1$$

wherein, (1) $1_1$(mm) is a distance from the tip end position detecting device 20 to the transfer position K (2) $v_1$(mm/sec) is a recording sheet conveying velocity.

The recording sheet 10 stops once, after the sheet feeder is selected from any one of the main sheet feeder 21, optional sheet feeder $22_1$, or $22_2$, and then fed out from the sheet feeder and detected by the tip end position detecting device 20. If $1_1=(t_1+t_2)\times v_1$, the photoconductive element drive motor is started to be driven at the same time of starting the recording sheet 10 to be sent towards the transfer nip K after the sheet 10 stops for a time. If $1_1<(t_1+t_2)\times v_1$, the recording sheet 10 is started to be sent towards the transfer nip K after below-mentioned delay time $t_3$ is passed from the time which the photoconductive element motor starts to be driven, after the recording sheet 10 is stopped for a time.

$$t_3=(t_1+t_2)-1_1/v_1(\text{sec})$$

According to the above operation, the time period needed from the starting of the photoconductive element motor's rotation to the arrival of the tip end of the recording sheet at the starting of the transfer nip K is made constant $(t_1+t_2)$ and the time is made minimal regardless of the kind of the selected sheet feeder (main feeder or optional feeder).

(Second Embodiment)

Figure 2:
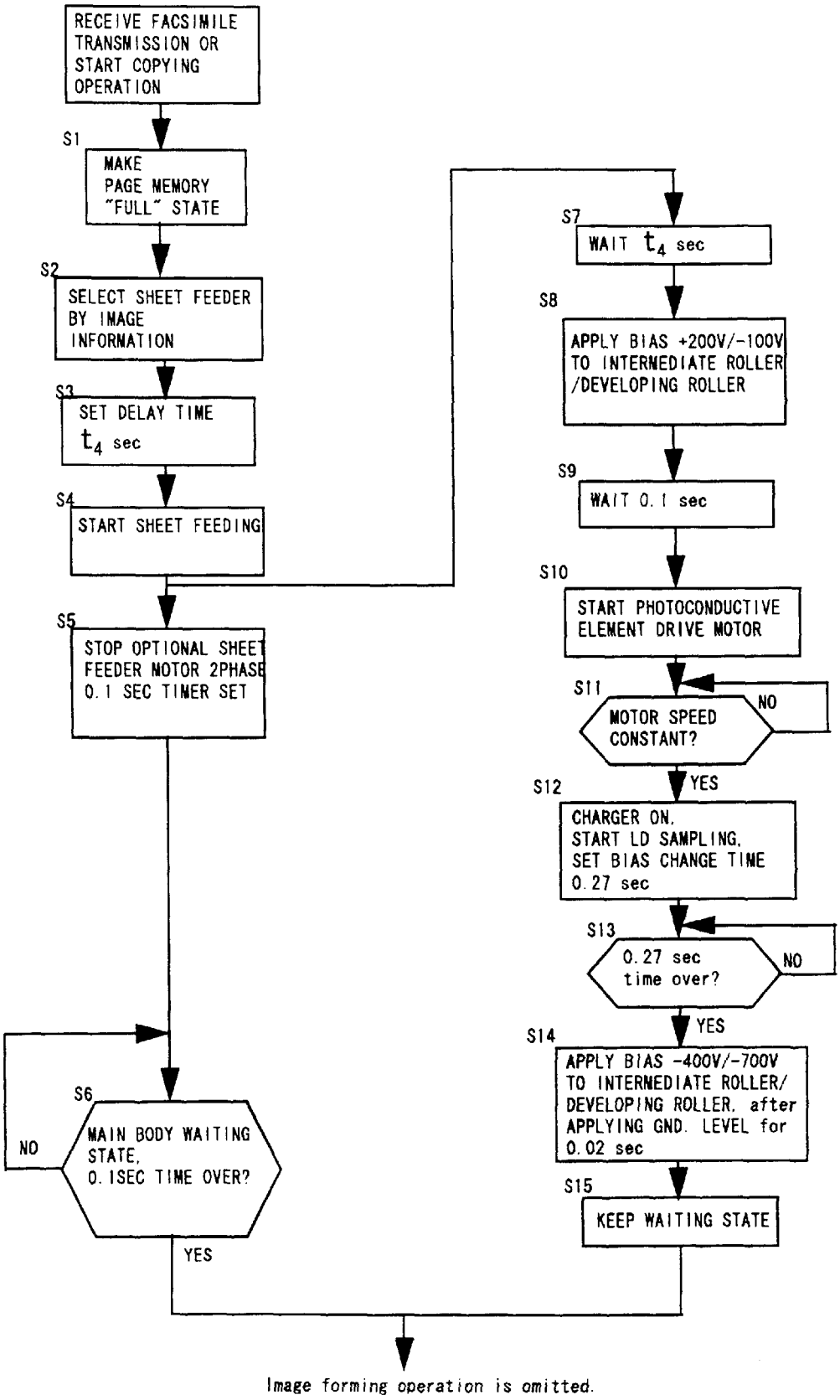
FIG. 2 is a flowchart showing above embodiment according to the present invention.

FIG. 2 is a flowchart explaining second embodiment of the present invention. If an electrophotographic apparatus is a facsimile device, the apparatus prepares for recording the image at the time of receiving the transmission of information. If the apparatus is a copying machine, the electrophotographic apparatus prepares for recording the image at the time of pressing a copy start button by an operator.

At first, image information is memorized in a page memory for amount of one page. When the page memory is brought to a state to "Full" in step S1, a controller determines the size of the recording sheet from the amount of the image information in the page memory, and selects the sheet feeder (main feeder, optional feeder 1, or optional feeder 2) in accordance with the determined recording sheet size in step 2. Furthermore, the controller determines delay time $t_4$ in step 3, according to the selected sheet feeder in step 3. The delay time $t_4$ thus determined will be described below.

If the time period from the start of sheet feeding to the arrival at the transfer nip position K for the recording sheet is obtained as below mentioned degrees, the delaying time $t_4$ is determined by the following equation, for example:

$$t_4=t_{5-}-t_{s-1}(\text{n=1, 2, 3, 4})$$

to make the rotating time of the photoconductive element 1 for all of the sheet feeders equal to the rotating time of the photoconductive element of the case of the main feeder.

The time from the start of sheet feeding to the arrival at the transfer nip K for the recording sheet is as follows:

main sheet feeder: $t_{s-1}$=1 sec;

first optional sheet feeder: $t_{5-2}$=2 sec;

second optional sheet feeder: $t_{5-3}$=3 sec; and second roll sheet feeder: $t_{5-4}$=6 sec For example, if the second optional sheet feeder is selected, the delaying time is 3 sec−1 sec=2 sec. Furthermore, the minimal time to rotate for the photoconductive element 1 needed from the start of rotation to the time when the recording sheet 10 reaches the transfer section 5 on image forming system is obtained by below equation.

$$t_{5-1}=(t_1+t_2)$$

Referring again to FIG. 2, A sheet feeding operation of the sheet feeder which is selected in step 2 starts (the rotation of a motor of the optional sheet feeder starts) in step 4. Two of the movements, those are, a movement of the recording sheet and a movement of the main body of the electrophotographic apparatus proceed as parallel movement from this step. At first, the motor of the optional sheet feeder is stopped once and the recording sheet which is started to be fed in step 4 is stopped at, for example, a position of the registration rollers pair, and a timer for stopping the motor of the optional sheet feeder for 0.1 sec is set at the same time in step 5. The controller judges whether or not the main body of the electrophotographic apparatus is in a "Waiting" state and the motor of the optional sheet feeder keeps the stopping state for 0.1 sec in step 6. If the answer is "YES", the controller starts an image forming operation that following the above stopping state. Here, the description thereof is omitted. If the answer is "NO", the controller repeats watching routine until the answer changes to "YES". On the other hand, in the main body of the electrophotographic apparatus, just after starting sheet feeding operation in step 4, the delaying time $t_4$ is set by a timer in step 7. Bias voltages of an intermediate roller and a developing roller are respectively set from a state of OFF to +200 volt and −100 volt in step 8 after $t_4$ sec elapses in step 7. The state in step 8 is kept for 0.1 sec in step 9. Next, the photoconductive element drive motor starts driving in step 10. Then, the controller judges whether or not the rotation of the photoconductive element motor reaches the regular number of revolution in step 11. If the answer is "NO", the controller watches the number of the revolution of the motor until the rotation reaches the state of the regular number of the revolution. If the number of the revolution of the motor reaches the state of the regular number of the revolution, the controller puts a charger in a tuning-on state from a turning-off state, and at the same time, LD sampling for controlling power and detecting synchronization of an optical writing is executed in step 12. Further, a timer 0.27 sec for counting a developing bias changing time (time when the position being charged at first on the photoconductive element moves to the developing position) is set in step 12. After 0.27 sec elapses, the controller instructs to change the bias voltage for the intermediate roller and the developing roller in step 13. The controller instructs the bias voltages of the intermediate roller and the developing roller to turn off once for 0.02 sec, and then to be −400 volt and −700 volt respectively for each roller in step 14. The main body of the electrophotographic apparatus is brought to a state of "Waiting" in step 15. The normal image recording operation of the electrophotographic apparatus such as an optical writing of the image information as an image forming procedure following the previous procedure is executed when the "Waiting" state is recognized in previous step 6.

(Third Embodiment)

Figure 3:
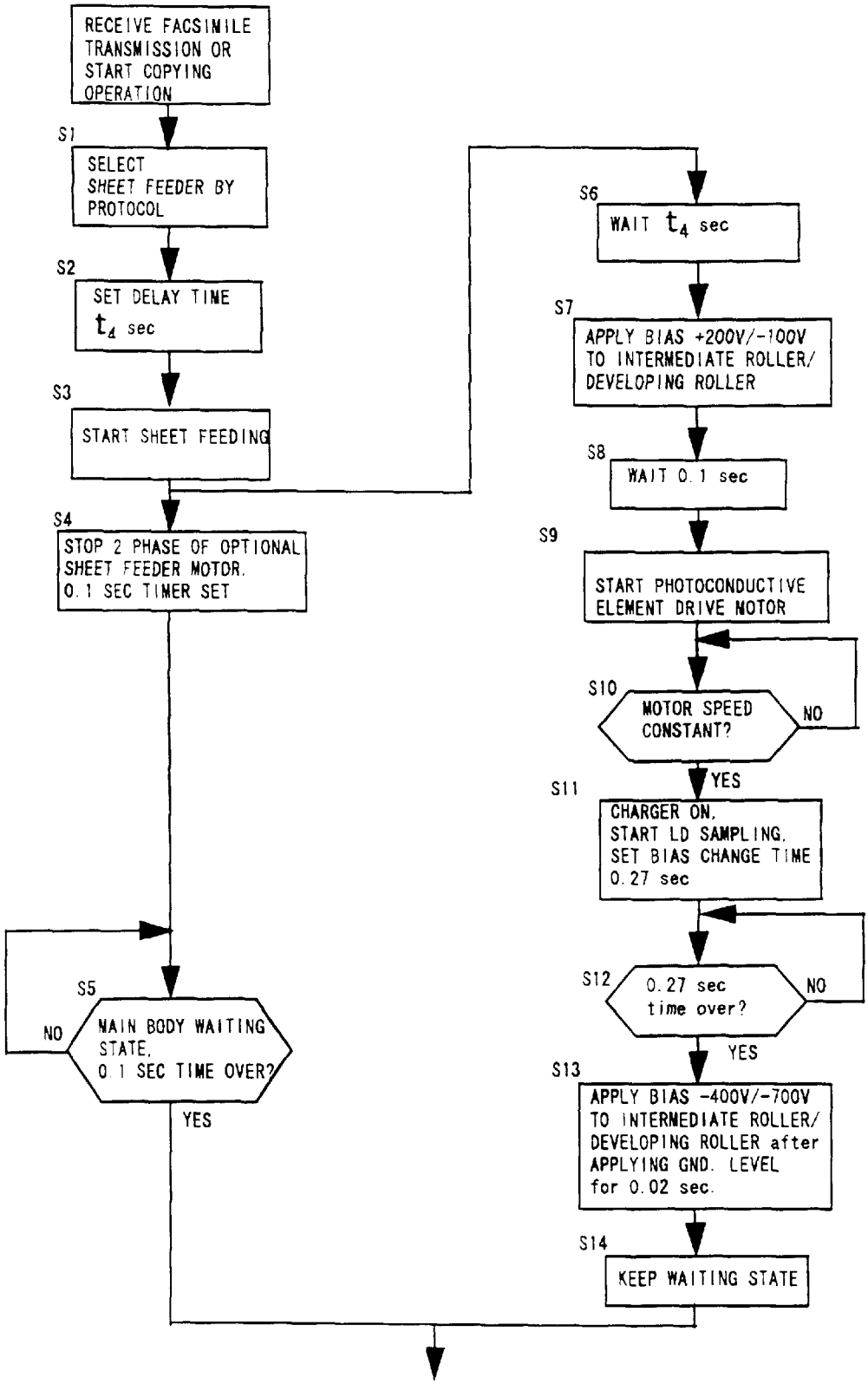
FIG. 3 is a flowchart showing another embodiment of the present invention.

FIG. 3 is a flowchart explaining third embodiment of the present invention which is applied to a facsimile device.

The electrophotographic apparatus starts preparation for image recording at a time of receiving transmission and determines the size of the recording sheet from protocol information which is transmitted after starting the transmission receiving. The feeder is selected in step 1 in accordance with the size of the recording sheet determined by the controller. Next, the delay time $t_4$ is set in step 2 of FIG. 3 in the same way as in step 3 in FIG. 2. The rest of all steps for image recording are executed as the same as FIG. 2, and therefore, the explanation of the flowchart in FIG. 3 is omitted.

Furthermore, if the electrophotographic apparatus is a printer, the sheet feeder is selected in accordance with the size of the recording sheet determined at a starting time of one job. The image recording operation is executed in the same way as in FIG. 2, and the delay time $t_4$ is set in a similar way to the aforementioned procedure.

(Fourth Embodiment)

An electrophotographic apparatus having only one optional sheet feeder pre-feeds a recording sheet from the optional sheet feeder. The timing when the recording sheet is pre-fed is, between the time when the power of the main body is turned on and the time to start image recording operation, or between the time when the recording sheet is finished to be fed out and the time when the apparatus starts next sheet feeding operation. The tip end position of the recording sheet after pre-fed stays at the position which satisfy a below mentioned condition before the recording sheet meets with another recording sheet fed from the main sheet feeder.

When $t_{5-1}$ is the period between the time when the recording sheet starts from the main sheet feeder and the time when the recording sheet turns on the registration sensor G, and $t_7$ is the period between the time when the recording sheet is started to be fed again after pre-fed and the time when the recording sheet turns on the registration sensor G of the main body, below mentioned equation is satisfied.

$$t_7=t_{5-1}$$

A stopping position of the pre-fed recording sheet may be controlled by a timer from the time of sheet feeding operation of the optional sheet feeder, or may be stopped in accordance with the output of the position detecting device which is mounted on the optional feeder. The image recording time is the same when the sheet is fed from the main feeder or the optional feeder as $$t_7=t_{5-1}$$

if the image is started to be recorded in a state of pre-feeding of the sheet. Furthermore, if $t_{5-1}=(t_1+t_2)$, the number of the revolution of the photoconductive element is minimal in the image forming operation from which the photoconductive element 1 starts rotation to which the recording sheet 10 reaches the transfer section 5.

(Fifth Embodiment)

The minimal requested rotating time in the image forming system from turning on of the charge applying charger 2 to reaching the transfer section 5 for the recording sheet 10 is given $t_8$; time from optical writing for the part of the photoconductive element which is charged at a charge applying process, being developed, to reach the transfer position (rotating time for the photoconductive element from the charge applying process to the position of transfer nip K).

Furthermore, the mounting position of the recording sheet tip end position detecting device 20 is the position on which below equation is satisfied, when $1_1$: a distance between the recording sheet tip end position detecting device 20 and the transfer position, and $v_1$ is a velocity of conveying the recording sheet.

$$1_1<t_{8\times v1}$$

The recording sheet 10 stops once after the tip end position thereof is detected by the recording sheet tip end position detecting device 20, and the sheet is fed from the main sheet feeder or the optional sheet feeder after the sheet feeder is selected. In a case of $1_1=t_8\times v_1$, the controller starts the charge applying charger 2, at the same time, from sending the recording sheet being stopped once, towards the transfer nip K. In the case of $1_1<t_{8\times v1}$, the recording sheet 10 is started to be sent towards the transfer nip K at a time passing $t_3=t_8-1_1/v_1$, from turning on of the charge applying charger, after the recording sheet 10 stopped for a time. According to this operation, the time $t_8$ from the photoconductive element motor starts its rotation, to the time when tip end position of the recording sheet reaches the transfer nip K is constant and brought to a state to minimal.

(Sixth Embodiment)

Figure 4:
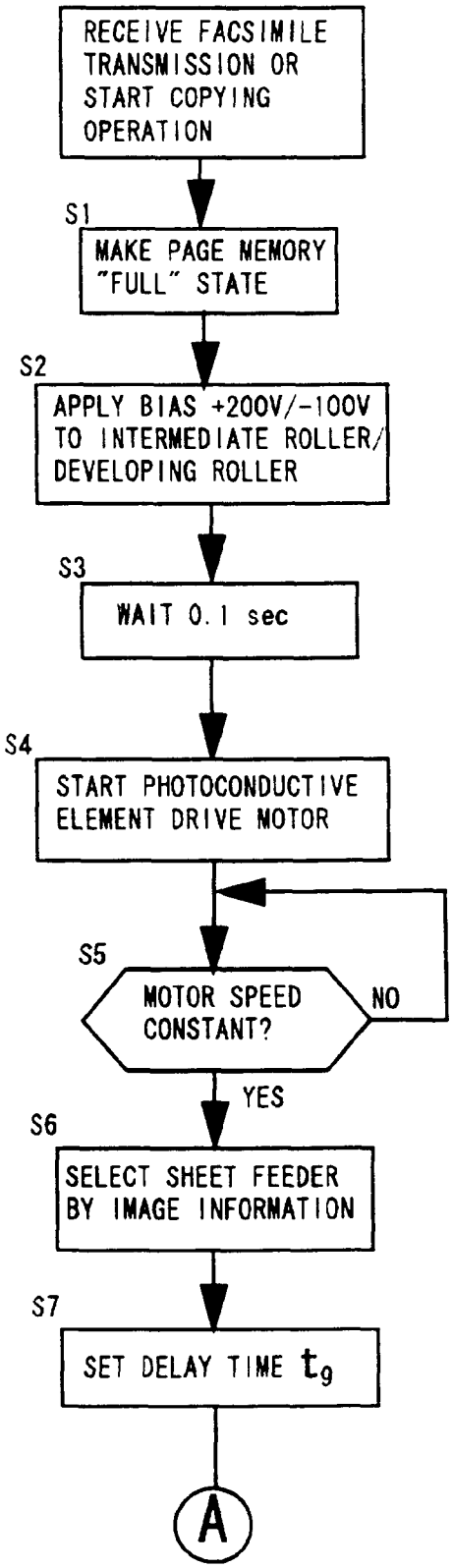
FIG. 4 is a flowchart showing still another embodiment according to the present invention.
Figure 5:
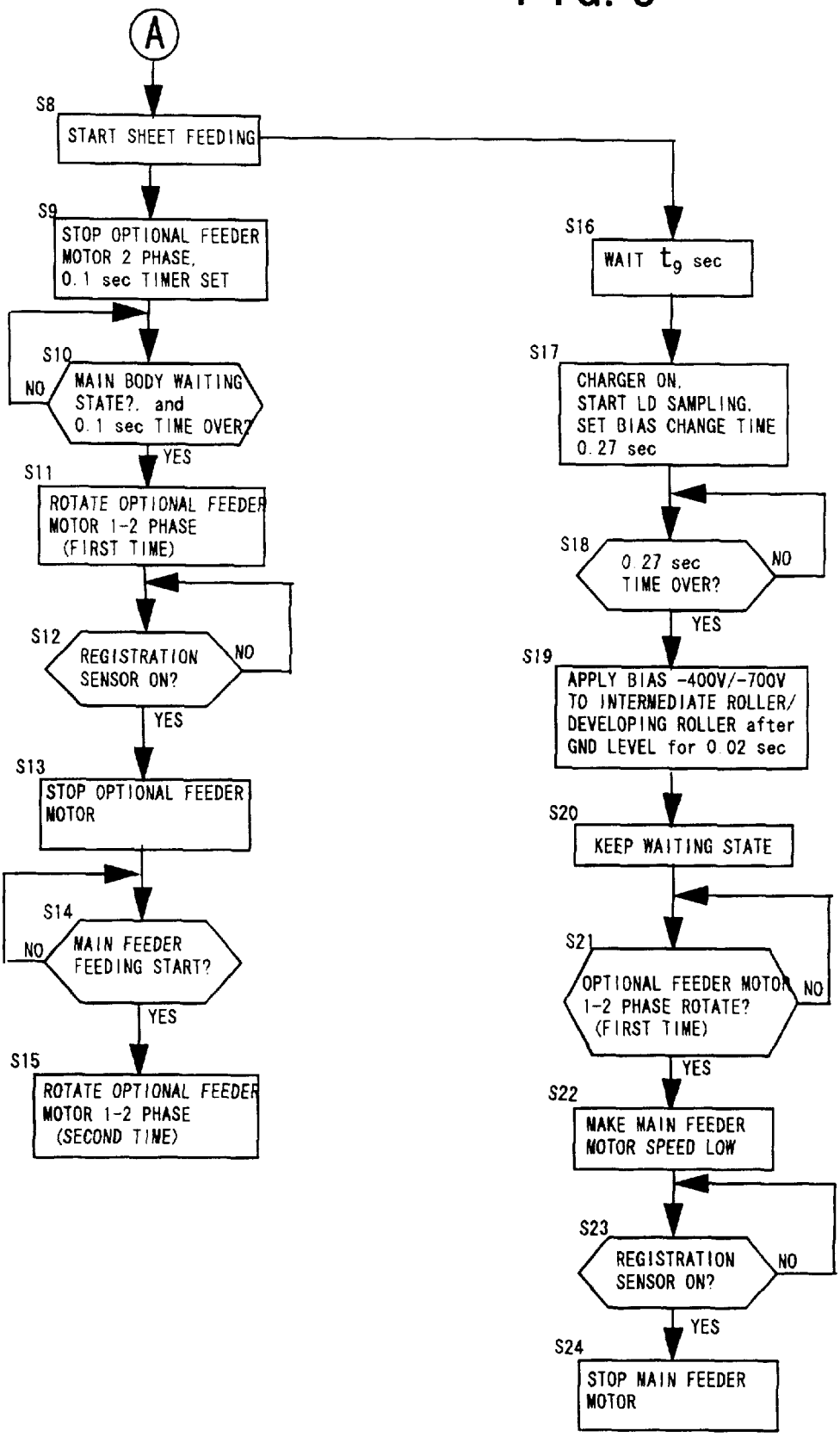
FIG. 5 is a flowchart to be connected to the flowchart as shown in FIG. 4.

FIGS. 4 and 5 are a flowchart to be combined into one showing sixth embodiment of the present invention. If an electrophotographic apparatus is a facsimile device, the apparatus prepares for recording the image at the time of receiving the transmission of image information. Furthermore, if the electrophotographic apparatus is a copying machine, the electrophotographic apparatus prepares for image recording at the time of pressing a copy start button by an operator.

At first, image information is memorized in a page memory for amount of one page. When the page memory is brought to a state "Full" in step S1, The bias voltages of the intermediate roller and developing roller are changed from turning-off state to +200v and −100v, respectively, in step 2. This state of step 2 is kept for 0.1 sec in step 3. Next, the photoconductive element motor starts to rotate in step 4, and the controller checks whether or not the number of revolution of the photoconductive element reaches constant revolution number in step 5. If the answer is "NO", the controller continues to watch the number of the revolution until the number of the revolution reaches the constant revolution number. If the answer is changed to "YES", the controller determines appropriate recording sheet size according to an amount of the page memory, and in accordance with the determined size of the recording sheet, the controller selects the feeder (main feeder, first optional feeder, second optional feeder) in step 6. Furthermore, according to the selected sheet feeder, the delaying time $t_9$ is set in step 7. Setting of the delaying time $t_9$ is explained in detail below.

When the time periods from of starting the sheet feeding of each feeder to the arrival at the transfer nip for the tip end of fed recording sheet are, respectively:

main feeder; $t_{5-1}=1$ sec first optional feeder; $t_{5-2}=2$ sec second optional feeder; $t_{5-3}=3$ sec second roll feeder; $t_{5-4}=6$ sec, the delay time $t_9$ is, for example, $$t_9=t_{5-n}-t_8(n=1, 2, 3, 4),$$

if the rotating time is required to be same in all of the feeders as the main feeder. Then, the required minimum rotating time from the starting of the rotation of the photoconductive element 1 to the time when the recording sheet 10 reaches the transfer section 5 on the image forming system is given.

Referring to FIGS. 4 and 5 again, the sheet feeding operation (the rotation of the optional sheet feeder motor) in which the selected one in step 6 is started in step 8. Two of the movements, those are, a movement of the optional sheet feeder and a movement of the main body of the electrophotographic element proceed as parallel movements from this step.

At first, the optional sheet feeder motor is stopped once, and the recording sheet started to be fed in step 8 is stopped in step 9. The timer for stopping the optional sheet feeder motor for 0.1 sec is started at the same time. The controller judges whether or not the main body of the electrophotographic apparatus is in a "Waiting" state, and aforementioned 0.1 sec timer stops its operation in step 10. If the answer is "NO", the watching routine is repeated until the answer is changed to "YES". If the answer is "YES", the controller starts to drive the optional sheet feeder motor again and starts to feed the sheet in step 11. When the registration sensor is turned "ON" in step 12, the optional sheet feeder motor is stopped again in step 13. The controller judges whether or not the sheet feeding operation by the main feeder motor is started in this state in step 14. If the answer is changed to "YES", the optional feeder motor is started to be driven again and the recording sheet is conveyed in step 15.

Furthermore, the main body of the electrophotographic apparatus sets the delaying timer $t_9$ just after the sheet feeding operation is started in step 8, and after the time $t_9$ elapses in step 16, the impressive charger is changed from "OFF" state to "ON" state, and LD sampling (to light up once a laser diode for recognizing the start position of optical writing) is executed for detecting the synchronization of optical writing and power controlling. Furthermore, a timer 0.27 sec for counting the developing bias changing time, (time of when a position which is for executing the operation of charging onto the photoconductive element at first moves to the developing position) starts in step 17. After 0.27 sec elapses in step 18, the bias voltages of the intermediate roller and the developing roller are instructed to be changed and turned off once for 0.02 sec by the controller, and then the controller respectively apply −400v and −700v thereto in step 19. Then the apparatus is brought to an "Waiting" state at the same time in step 20. During the "Waiting" state, if the controller recognizes the driving of the optional sheet feeder motor in step 11, and in step 21, the main sheet feeder motor starts its rotation in step 22. When the registration sensor is turned on in step 23, the main sheet feeder motor stops in step 24. Hereinafter, a usual image recording procedure of the electrophotographic apparatus such as an optical writing of the image information or the like is executed.

(Seventh Embodiment)

Figure 6:
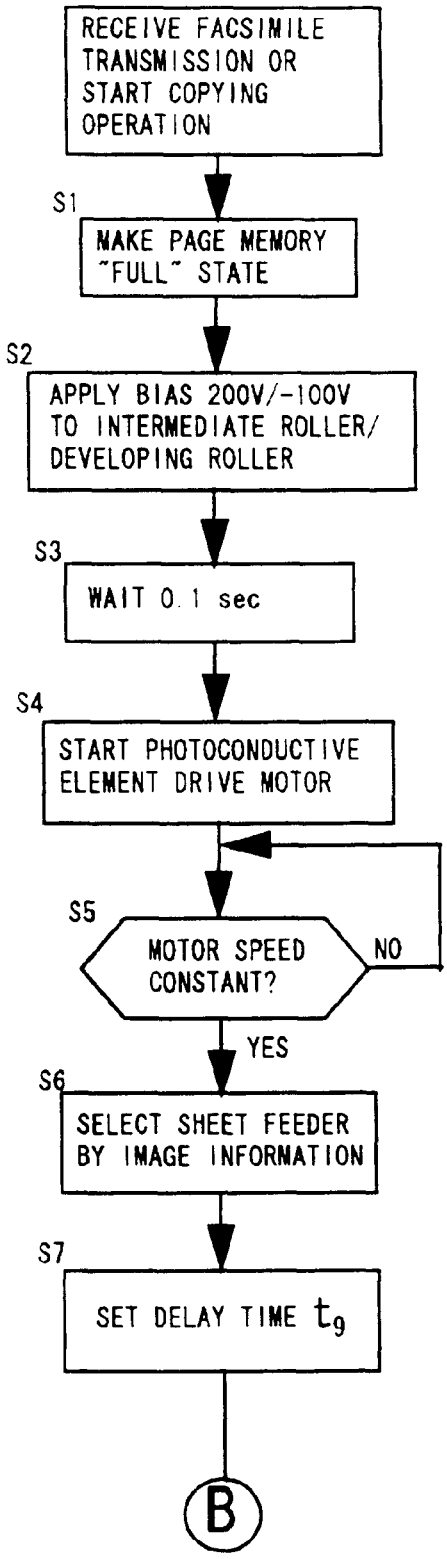
FIG. 6 is a flowchart showing still another embodiment according to the present invention.
Figure 7:
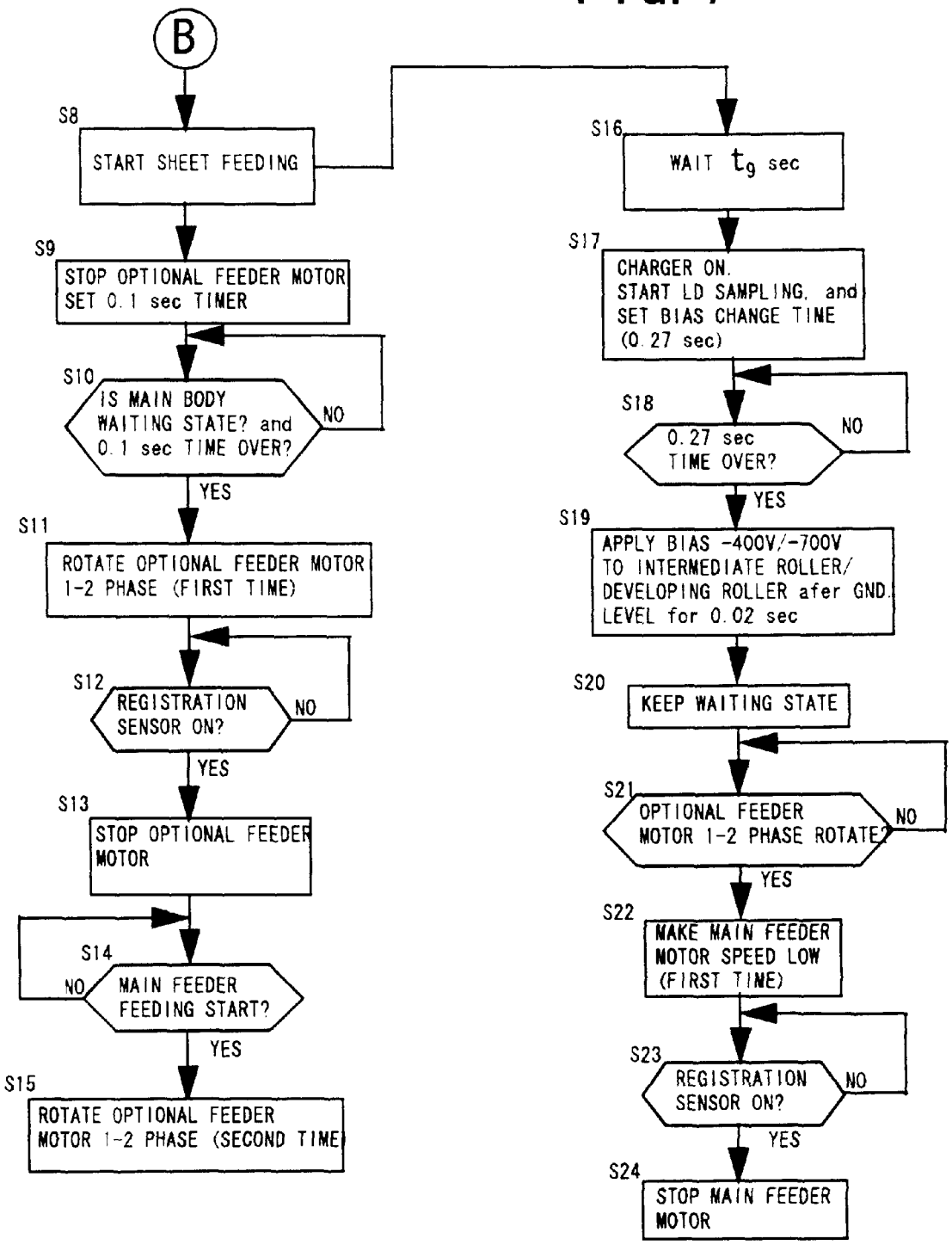
FIG. 7 is a flowchart to be connected to the flowchart as shown in FIG. 6.

FIGS. 6 and 7 are a flowchart showing seventh embodiment. The different point between FIGS. 6, 7 and FIGS. 4, 5 is that the size of the recording sheet is determined by the protocol information transmitted after starting the transmission receiving in step 6 in FIGS. 6 and 7. The rest of the FIGS. 6 and 7 are the same as here that of FIGS. 4 and 5. Therefore, a detailed explanation is omitted.

Furthermore, in the case of using the electrophotographic apparatus as a printer, the sheet feeder is selected in accordance with the size of the recording sheet determined at a start time of one job at the step 6 in FIGS. 4 and 5, and the delaying time $t_4$ is set by the same procedure.

The controller of this invention may be conveniently implemented using a conventional general purpose digital computer or microprocessor programmed according to the teachings of the present specification, as will be apparent to those skilled in the computer art. Appropriate software coding can readily be prepared by skilled programmers based on the teachings of the present disclosure, as will be apparent to those skilled in the software art. The invention may also be implemented by the preparation of application specific integrated circuits or by interconnecting an appropriate network of conventional component circuits, as will be readily apparent to those skilled in the art.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United states is:

1. An electrophotographic apparatus comprising:

optional sheet feeders provided in addition to a main sheet feeder;

charge applying device for applying charge to a photoconductive element;

recording sheet detecting means for detecting a tip end portion of a recording sheet fed from either said main sheet feeder or one of said optional sheet feeders wherein the output of said recording sheet detecting means has a plurality of values with each of said plurality of values corresponding to a respective one of said main sheet feeder and said optional sheet feeders and wherein said charge applying means has a starting time in accordance with the output of said recording sheet detecting means.

2. An electrophotographic apparatus comprising:

a plurality of optional sheet feeders and a main sheet feeder;

a photoconductive element drive motor;

a recording sheet detecting sensor for detecting a recording sheet by detecting a tip end position of a recording sheet fed from one said plurality of optional sheet feeders and said main sheet feeder, wherein said recording sheet detecting sensor provides an output for controlling the driving of said photoconductive element drive motor and wherein said output of said recording sheet detecting sensor provides one of a plurality of predetermined outputs corresponding to a respective one of said plurality of sheet feeders and said main sheet feeder.

3. An electrophotographic apparatus comprising:

optional sheet feeders provided in addition to a main sheet feeder;

charge applying device for applying charge to a photoconductive element;

recording sheet detecting means for detecting a tip end portion of a recording sheet fed from either said main sheet feeder or one of said optional sheet feeders wherein the output of said recording sheet detecting means has a plurality of values with each of said plurality of values corresponding to a respective one of said main sheet feeder and said optional sheet feeders and wherein said charge applying device has a starting time determined in accordance with the output of said recording sheet detecting means.

4. An electrophotographic apparatus comprising:

a plurality of optional sheet feeders and a main sheet feeder;

an image forming device;

a recording sheet detecting sensor for detecting a tip end position of a recording sheet fed from one said plurality of optional sheet feeders and said main sheet feeder, wherein said recording sheet detecting sensor provides an output for controlling the driving of a photoconductive element drive motor and wherein said recording sheet detecting sensor provides one of a plurality of predetermined outputs corresponding to a respective one of said plurality of sheet feeders and said main sheet feeder.

5. An electrophotographic apparatus comprising:

a plurality of optional sheet feeders and a main sheet feeder;

a photoconductive element drive motor;

a recording sheet detecting sensor for detecting a tip end position of a recording sheet fed from one said plurality of optional sheet feeders and said main sheet feeder, wherein said recording sheet detecting sensor provides an output for controlling the driving of said photoconductive element drive motor and wherein said output of said recording sheet detecting sensor includes one of a plurality of predetermined outputs corresponding to a respective selected one of said plurality of sheet feeders and said main sheet feeder.

* * * * *